US005404663A

United States Patent [19]

Schober

[11] Patent Number: 5,404,663

[45] Date of Patent: Apr. 11, 1995

[54] DECORATIVE OVERLAY FOR USE IN FRAMING ART WORK

[75] Inventor: Vicki Z. Schober, Whitefish Bay, Wis.

[73] Assignee: Vicki Schober Company, Milwaukee, Wis.

[21] Appl. No.: 106,201

[22] Filed: Aug. 12, 1993

[51] Int. Cl.[6] ..... B44C 5/02

[52] U.S. Cl. ..... 40/158.1; 40/152

[58] Field of Search ..... 40/158.1, 152

[56] References Cited

U.S. PATENT DOCUMENTS

| | | | |
|---|---|---|---|
| 314,008 | 3/1885 | Fontaine | 40/158.1 |
| 460,663 | 10/1891 | Searvogle | 40/158.1 |
| 2,428,242 | 9/1947 | Prost | 40/158.1 |
| 3,133,375 | 5/1964 | Myren | 40/152 |
| 3,789,529 | 2/1974 | Thom | 40/158.1 |
| 4,165,408 | 8/1979 | Pierce | 40/158.1 |
| 4,301,199 | 11/1981 | Pfanstiehl | 40/158.1 |
| 5,025,579 | 6/1991 | Krueger | 40/152 |
| 5,286,558 | 2/1994 | Seo et al. | 40/152 |

*Primary Examiner*—Edward K. Look
*Assistant Examiner*—Mark Sgantzos
*Attorney, Agent, or Firm*—Michael, Best & Friedrich

[57] ABSTRACT

Art work matting in the form of one or more elongated overlay parts of a light weight, low density, easily cuttable matting material, such as foam polystyrene, having a bevelled edge and a layer of sheet decorative material, such as marbled paper, covering and bonded to the bevel edge and portions of the front and back surfaces of the overlay strip extending immediately adjacent the bevelled edge. The overlay parts can be cut into sections which are fitted together with mitered or butt joints to form a rectangular overlay having an opening corresponding to the desired display portion of the art work. When a window board having an opening generally coinciding with the overlay opening is placed over the overlay, only the angular surface of the bevelled edge covered with a decorative material is exposed, giving the appearance of a decorative fillet bordering the display portion of the art work.

15 Claims, 2 Drawing Sheets

DECORATIVE OVERLAY FOR USE IN FRAMING ART WORK

BACKGROUND OF THE INVENTION

1. Field of the Invention

This invention relates to framing art work and the like and, more particularly, to framing art work with matting materials.

2. Description of Prior Art

Framing art work with matting materials typically involves the use of two pieces of mat board, a support or back board to which the art work is attached and a front or window board having an opening through which the viewable portion of the art work is displayed. In some cases, a decorative wood fillet bordering the display portion of the art work is used. Such a fillet usually is made from four pieces of material which are fitted and taped together and laid over the art work prior to placing the window board over the art work.

SUMMARY OF THE INVENTION

An object of the invention is to provide art work matting which can be formed into an overlay for placement between the art work and a window board to provide the appearance of a decorative fillet.

Another object of the invention is to provide a method for making such art work matting.

A further object of the invention is to provide a method for framing art work with mat boards to provide the appearance of a decorative fillet bordering the display portion of the art work.

Other objects, aspects and advantages of the invention will become apparent to those skilled in the art upon reviewing the following detailed description, the drawing and the appended claims.

The invention provides art work matting for use to form an overlay which can be placed between art work and a window board to provide the appearance of a decorative fillet bordering the display portion of the art work. The matting includes one or more overlay parts of a light weight, low density, easily cuttable matting material, such as foam polystyrene, having a bevelled edge and a layer of sheet decorative material, such as marbled paper, covering and bonded to the bevelled edge and portions of the front and back surfaces of the overlay parts extending immediately adjacent the bevelled edge. The overlay parts are cut into sections which are fitted together to form a rectangular overlay having an opening corresponding to the desired display portion of the art work with the bevelled edge surrounding this opening and the angular surface thereof facing outwardly.

The decorative material preferably is in sheet form and, in accordance with one embodiment of the invention, a double covered adhesive is applied to the back side of the sheet, an adhesive-backed sheet is cut into strips and a strip of decorative material, after the cover sheet is peeled off, is placed over and pressed against the bevelled edge and the portions of the front and back and surfaces of the overlay strip extending immediately adjacent the bevelled edge.

For framing, the overlay is placed over art work supported on a support medium or back board and a window board, having an opening with a perimeter generally coinciding with the overlay opening at the front surface, is placed over the overlay. The back board, art work, overlay and window board, with or without glass, are installed in a frame in the usual manner.

DESCRIPTION OF THE PREFERRED EMBODIMENTS

Figure 1:
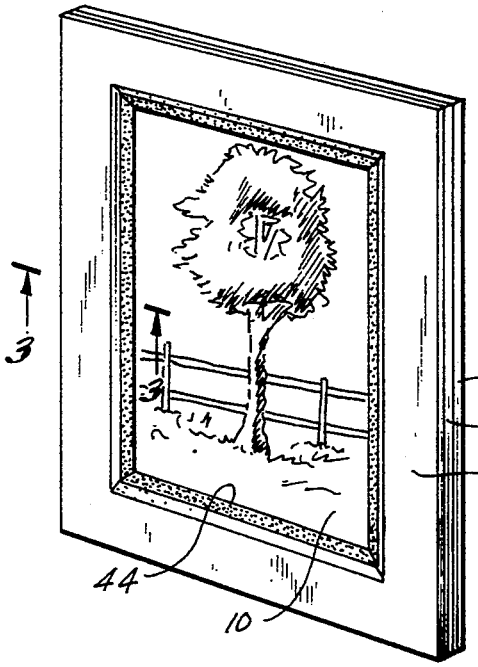
FIG. 1 is a perspective view of art work matted in accordance with the invention prior to placement in a frame.
Figure 2:
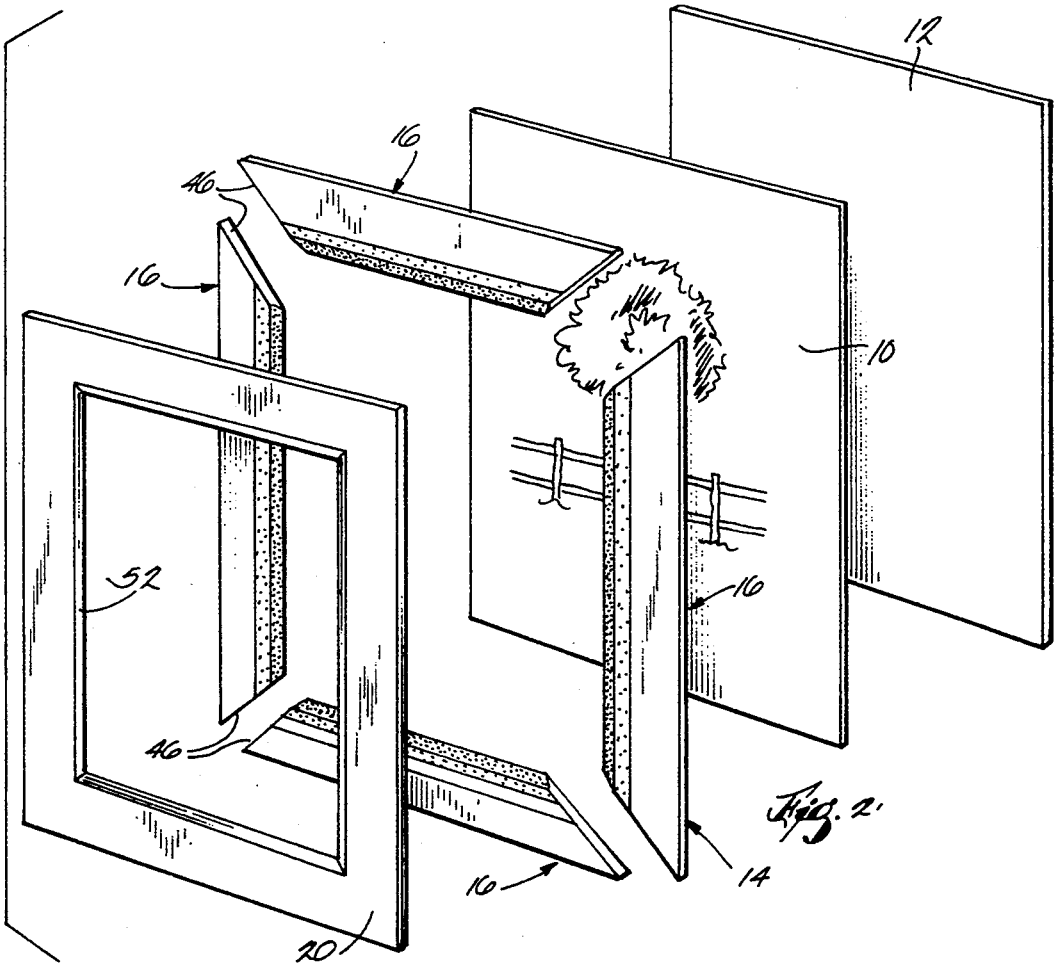
FIG. 2 is an exploded view of the various parts shown in FIG. 1.

Illustrated in FIGS. 1 and 2 is a piece of art work ready for placement in a frame (not shown). The art work 10 is supported on a support medium or back mat board 12 and covered with an overlay 14 made from four overlay sections 16 cut from overlay parts 18 (FIG. 4) of the invention and a window mat board 20.

Figure 4:
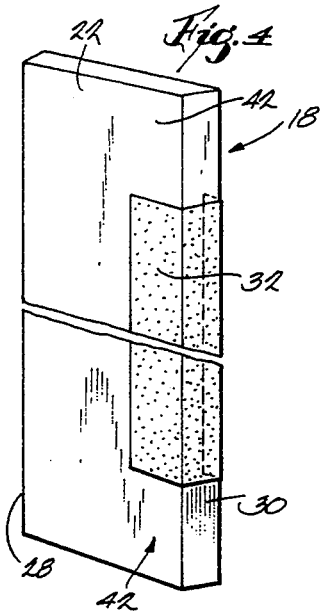
FIG. 4 is an enlarged, fragmentary, perspective view of an overlay part of the invention.
Figure 3:
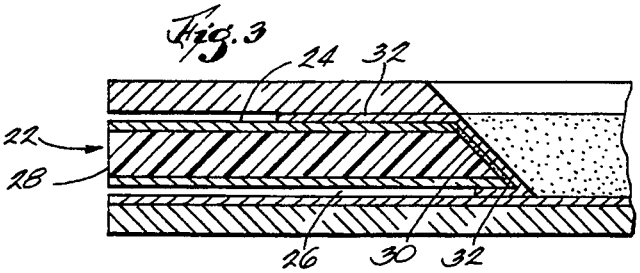
FIG. 3 is an enlarged, sectional view taken generally along line 3—3 in FIG. 1.

Referring to FIGS. 3 and 4, each overlay part 18 (one show) includes an elongated strip 22 of art matting material having opposed front and back surfaces 24 and 26 and opposed edges 28 and 30 with the edge 30 being bevelled and a strip 32 of sheet decorative material extending over and bonded to the bevelled edge 30 and portions of the front surface 24 and the back surface 26 of the overlay strip 22 extending immediately adjacent the bevelled edge 30. The overlay strip 22 is made from a light weight, low density, easily cuttable matting material. Various commercially available art matting materials having these characteristics, preferably a blown or foam polystyrene type matting, can be used. For example, foam board, marketed by Creative Industries under the trademark AMERICORE for use as a backing material, is particularly suitable. The front and back surfaces 24 and 26 of the overlay strip 22 preferably are a layer of a paper, most preferably a clay-coated, white kraft paper, covering a core 33 of foam polystyrene board.

While the overlay strip 22 can have various thicknesses, widths and lengths, as a guide it can be about 3/16 inch thick, about 4 inches wide and about 32 inches long.

Figure 5A:
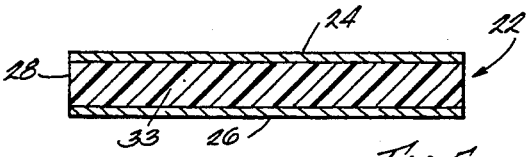
FIGS. 5*a*–5*c* are cross sectional views of an overlay strip of matting material prior to bevelling one edge, after bevelling one edge and after a sealing material has been applied to the angular surface of the bevelled edge, respectively.
Figure 5B:
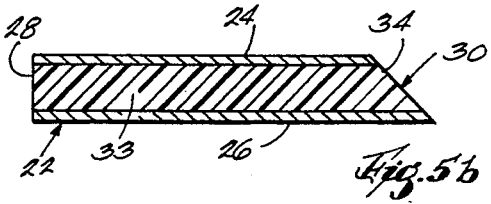
Figure 5C:
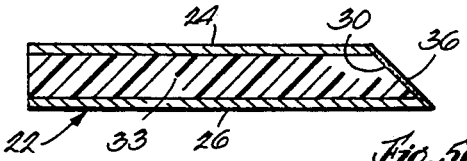

As best shown in FIGS. 5*a* and 5*b*, the bevelled edge 30 preferably is cut with a suitable cutting tool at about 45° and extends upwardly at an angle from the back surface 26 of the overlay strip 22 toward the other edge 28. When the overlay strip 22 is made from a foam polystyrene, the angular surface 34 of the bevelled edge 30 is quite porous and uneven. To promote good bonding of the decorative material, as best shown in FIG. 5*c*, the angular surface 34 of the bevelled edge 30 preferably is coated with a sealing material 36 which adheres to the polystyrene to provide a relatively flat bonding surface. Various suitable sealing materials can be used for this purpose. A starch-based composition marketed under the name Aleene's 2 in 1 Fabric Stiffener and Fabric Draping Solution has been found to be particularly effective because one coat can provide a suitable bonding surface. Other coating materials, such as acrylic paints, tend to be absorbed into the pores of the polystyrene. Consequently, several coatings may be required to provide a desirable bonding surface and, for that reason, such materials are less desirable.

Various different suitable types of decorative sheet material can be used. Relatively thin sheets of plain or textured decorative paper and cloth are preferred. While the decorative material can be one solid color, it preferably is patterned to provide an enhanced aesthetic appeal. A particularly suitable decorative material is marbled paper of the type used in binding expensive books.

The decorative material strip 32 preferably is bonded to the overlay strip 22 with a suitable adhesive. In a preferred embodiment, an adhesive is applied to the back side of a sheet of decorative material in the form of a double-coated transfer tape including a polyester film coated on both sides with an acrylic adhesive 38 (FIG. 6*a*) and silicone-coated release paper 40 covering both sides of the adhesive 38. A suitably commercially available double coated tape is Polyken 126 marketed by the Polyken Division of The Kendall Company, Boston, Mass. This tape has a total thickness of about 3.5 mils and the adhesive is about 2 mils.

To reduce production costs, such a tape can be laminated onto the back side of sheets of decorative material, after the release paper has been peeled off one side of the tape, and the resulting adhesive-backed sheet cut into strips 32 of the desired width. For example, a sheet of this type transfer tape can be laminated onto the back side of 20 inches by 25 inches sheet of marbled paper and the adhesive-backed sheet cut into strips 1½ inches wide.

Figure 6A:
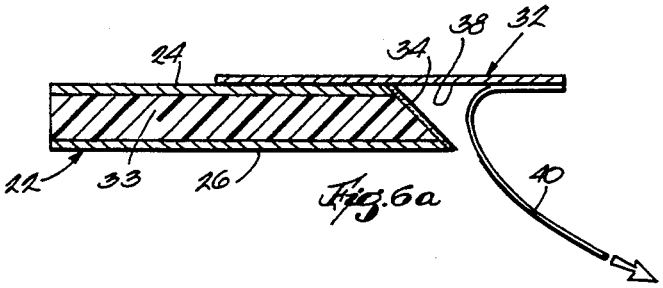
FIGS. 6*a* and 6*b* are cross sectional views similar to FIGS. 5*a*–5*c* illustrating one technique for applying a decorative material strip to an overlay strip.
Figure 6B:
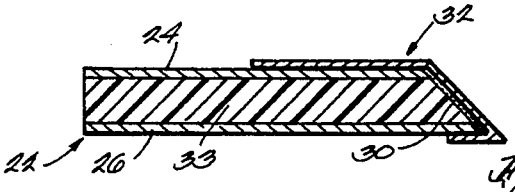

A decorative material strip 32 is applied to an overlay strip after the angular surface 34 of the bevelled edge 30 has been coated with a sealing material. FIGS. 6*a* and 6*b* illustrate one technique for applying a decorative material strip 32 after the release paper 40 covering the adhesive 38 on the back side has been peeled off. One edge portion of the decorative material strip 32 is placed over and pressed against a portion of the top surface 24 of the overlay strip 22 extending immediately adjacent the bevelled edge 30 as shown in FIG. 6*a*. The decorative material strip 32 is then folded down over and pressed against the angular surface 34 of the bevelled edge 30 and finally folded over and pressed against a portion of the back surface 26 of the overlay strip 32 extending immediately adjacent the bevelled edge 30 as shown in FIG. 6*b*.

A larger portion of the decorative material strip 22 preferably is applied to the front surface 24 of the overlay strip 22 to insure that no uncovered part of the top surface 24 is exposed when framing is completed. For example, when the decorative material strips 32 are 1½ inches wide and the overlay strip 22 is 3/16 inch thick, approximately 1 inch of the decorative material extends over the front surface 24 and approximately ¼ inch extends over the back surface 26. To reduce costs, a portion 42 of one or both ends of each overlay part 18 is not covered with the decorative material. For example, when the overlay part 18 is 32 inches long and the decorative material strips 32 are 25 inches long, a 3½ inch long portion 42 at each end of the overlay part 18 is uncovered.

The overlay parts 18 usually are marketed in packets of four or more for use by professional art framers or do-it-yourself enthusiasts. For use, the overlay parts 18 are cut into four sections 16 (FIG. 2) which can be fitted together to form a rectangular overlay 14 having a rectangular opening 44 corresponding to the desired display portion of the art work 10 being framed. The bevelled edge 30 defines the opening 44 with the angular surface 34 thereof facing outwardly.

Figure 7:
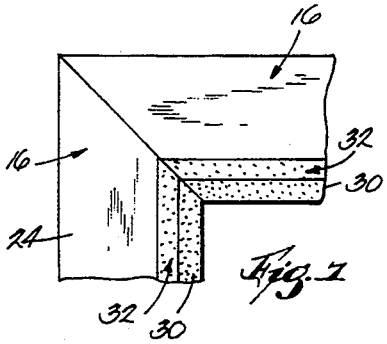
FIG. 7 is a fragmentary, plan view of an overlay made with miter joints.
Figure 8:
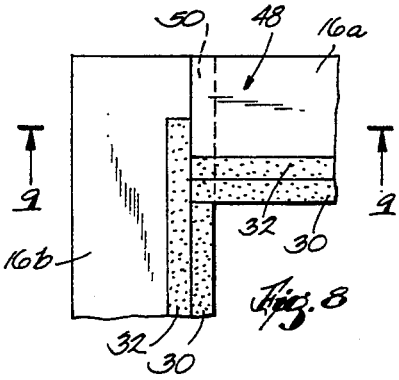
FIG. 8 is a fragmentary, plan view of an overlay made with butt joints.
Figure 9:
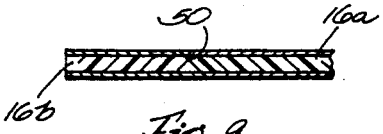
FIG. 9 is a sectional view taken generally along 9—9 in FIG. 8.

The opposite ends 46 of all four overlay sections 16 can be cut at a 45° miter as shown in FIGS. 2 and 7 to form mitered joints therebetween. Alternatively, as best shown in FIGS. 8 and 9, the opposite ends 48 of two of the overlay sections **16*a* can be cut at a bevel which is reverse to that of the bevelled edge 30 for the other two sections 16*b* (one shown). The two thus-bevelled overlay sections 16*a* fit against the bevelled edges 30 of the two overlay sections 16*b* and form butt joints therebetween. Since the overlay strips 22 are made from a relatively low density, matting material, preferably a foam polystyrene, they can be conveniently cut into sections with a razor blade or an Exacto type knife, rather than requiring a mat cutter as is the case with higher density matting materials. Also, because of the pliable nature of foam polystyrene, the sections 16** can be fitted together to form a tight mitered or butt joints.

After the sections 16 have been cut to form the desired joint, they are fitted and secured together, preferably with a suitable tape such as Scotch tape (not shown). While the tape can be applied to either the front surface 24 or the back surface 26 of the overlay parts 18, it preferably should be applied to both surfaces.

After an overlay 14 has been assembled as described above, it is placed over the art work 10 with the back surface 26 facing the art work 10 and positioned so that the overlay opening 44 coincides with the desired display portion of the art work 10.

The window board 20 is made from a suitable mat board by cutting therein an opening 52 having a perimeter generally coinciding with the overlay opening 44 at the front surface 24. The perimeter of the window board opening 52 can be the same as the overlay opening 44 at the front surface 24 so that only the bevelled edge 30 of the overlay 14 is exposed. However, if desired, the perimeter of the window board opening 52 can be slightly larger so that both the bevelled edge 30 and a small portion of the decorative material covering the front surface 24 of the overlay 18 is exposed. The back board, art work, overlay and window board are placed in a frame, with or without glass, in the usual manner.

The decorative material does not have to be non-acidic for many applications. When overlays employing an acidic decorative material are used with more expensive art work, a non-acidic mat board can be used between the art work 10 and the overlay 14. Alternatively, a non-acidic decorative material can be used.

From the foregoing description, one skilled in the art can easily ascertain the essential characteristics of the invention and, without departing from the spirit and scope thereof, make various changes and modifications to adapt it to various usages.

I claim:

1. Art work matting for forming an overlay for placement between art work and a window board to provide the appearance of a decorative fillet bordering the display portion of the art work, said matting comprising at least one elongated overlay part including a light weight, low density, easily cuttable core board of matting material having opposed front and back surfaces covered with a paper and opposed edges, one of said edges being bevelled at an angle extending upwardly from said back surface toward the other of said opposed edges; and a layer of sheet decorative material covering and bonded to said bevelled edge of said core board and only limited portions of the front and back surfaces of the core board covered with said paper extending immediately adjacent said bevelled edge, said overlay parts being cut into four separate sections which can be fitted together end to end to form a rectangular overlay having a rectangular opening corresponding to the desired display portion of the art work with said bevelled edge surrounding said opening and the angular surface thereof facing outwardly.

2. Art work matting according to claim 1 wherein said decorative material is paper.

3. Art work matting according to claim 2 wherein said paper is marbled.

4. Art work matting according to claim 1 wherein said core board is a foam polystyrene matting material.

5. Art work matting according to claim 1 wherein said bevel is about 45°.

6. Art work matting according to claim 1 wherein the front and back surfaces of said core board are covered with a clay-coated, kraft paper.

7. Art work matting according to claim 1 wherein said decorative material is bonded to said bevelled edge and said limited portions by an adhesive.

8. A method for making an overlay for use in mounting art work and for placement between the art work and a window board to provide the appearance of a decorative fillet bordering the display portion of the art work, said method comprising the steps of providing at least one elongated overlay part including a light weight, low density, easily cuttable core board of matting material having opposed front and back surfaces covered with a paper and opposed edges;

bevelling one edge of the core board;

covering and bonding to the bevelled edge of the cord board and only limited portions of said front and back surfaces of the core board covered with said paper and extending immediately adjacent said bevelled edge with a layer of sheet decorative material;

cutting said overlay parts into four sections which can be fitted together end to end to form a rectangular overlay having a rectangular opening defined by said bevelled edges and at the back surface corresponding to the display portion of the art work; and fitting and securing together said sections to form said overlay.

9. A method according to claim 8 wherein the core board is a foam polystyrene matting material.

10. A method according to claim 8 wherein said decorative material is a marbled paper.

11. A method according to claim 8 including the steps of applying a layer of adhesive covered with a peel-off release sheet to the back surface of a sheet of said decorative material;

cutting said sheet of decorative material into strips of the desired size to cover said bevelled edge and said limited portions;

peeling said release sheet off a strip of said decorative material;

positioning said strip of decorative material over said bevelled edge and said limited portions; and pressing said decorative material against said bevelled edge and said limited portions.

12. A method according to claim 9 including the step of coating the angular surface of said bevelled edge with sealing material prior to covering with said decorative material.

13. A method according to claim 8 wherein the opposite ends of each of said sections are cut at a 45° angle and fit against the end of another of said section to form a mitered joint therebetween.

14. A method according to claim 8 wherein the opposite ends of two of said sections are bevelled in reverse to said bevelled edge of said sections and fit against the bevelled edge of another one of said sections to form a butt joint therebetween.

15. A method for framing art work with an overlay made in accordance with claim 8 comprising the steps of placing the art work on a support medium;

placing said overlay over the art work with the back surface thereof facing the art work and said overlay opening aligned with the display portion of the art work;

forming a window board from an art mat by cutting an opening therein having a perimeter generally coinciding with said overlay opening at the front surface of said overlay;

placing the window board over said overlay with the openings of said overly and the window board aligned; and placing the support medium, art work, overlay and window board in a frame.

* * * * *